US010834492B2

(12) United States Patent
Feng et al.

(10) Patent No.: US 10,834,492 B2
(45) Date of Patent: Nov. 10, 2020

(54) MODULARIZED WIRELESS EARPHONE

(71) Applicant: OBO PRO.2 INC., Taoyuan (TW)

(72) Inventors: Jen-Nan Feng, Taoyuan (TW); Lin-Chuan Chiang, Taoyuan (TW); Yu-Ching Chen, Taoyuan (TW)

(73) Assignee: OBO PRO.2 INC., Taoyuan (TW)

( * ) Notice: Subject to any disclaimer, the term of this patent is extended or adjusted under 35 U.S.C. 154(b) by 0 days.

(21) Appl. No.: 16/411,740

(22) Filed: May 14, 2019

(65) Prior Publication Data

US 2020/0107105 A1 Apr. 2, 2020

(30) Foreign Application Priority Data

Sep. 28, 2018 (TW) ..... 107213352 U

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
None
See application file for complete search history.

(56) References Cited

U.S. PATENT DOCUMENTS

2019/0045295 A1* 2/2019 Kim ..... H04R 1/10

* cited by examiner

*Primary Examiner* — Kenny H Truong
(74) *Attorney, Agent, or Firm* — Muncy, Geissler, Olds & Lowe, P.C.

(57) ABSTRACT

A modularized wireless earphone includes an inner module, a power supply unit, a loudspeaker and an outer casing. The inner module is provided with a circuit module and an insulated casing. The circuit module includes a detection juncture used for detecting, an ANT sensor, a receiving microphone and a control switch. The detection juncture, the ANT sensor, the receiving microphone and the control switch are interconnected electrically. The insulated casing is used to enclose the circuit module and expose the detection juncture, the receiving microphone and the control switch outside an insulation body. The power supply unit is interconnected with the circuit module electrically to provide electricity, the loudspeaker is interconnected with the circuit module electrically, and the outer casing is used to enclose the inner module, the power supply unit and the loudspeaker.

12 Claims, 7 Drawing Sheets

MODULARIZED WIRELESS EARPHONE

BACKGROUND OF THE INVENTION a) Field of the Invention

The present invention relates to a modularized wireless earphone, and more particularly to a wireless earphone for which the assembly efficiency can be improved and the labor cost can be reduced.

b) Description of the Prior Art

As the progress of technology and the safety concern in commuting, the wireless earphone has replaced the conventional wired earphone gradually. In addition to that the wire can be easily pulled and dragged while using the wired earphone, an extra retracting action will be needed in storing the wired earphone. As the wire can be entangled easily if the retracting is not done accurately, the wiring can be damaged easily. Therefore, the wireless earphone has gradually replaced the conventional wired earphone.

However, as the existing wireless earphone sold on the market is getting smaller and smaller, the interior space of the wireless earphone is limited. Hence, it will need to emplace all of the parts and components in the limited space, which complicates the assembly procedure. As a lot of manpower and equipment will be invested to perform the assembling, the labor cost will be increased significantly.

Accordingly, how to provide a wireless earphone, for which the assembly procedure can be saved, the assembly efficiency can be improved and the labor cost can be reduced, is the technical means and the object to be solved by the present invention.

SUMMARY OF THE INVENTION

The primary object of the present invention is to provide a modularized wireless earphone, and more particularly to a wireless earphone for which the assembly efficiency can be improved and the labor cost can be reduced.

To achieve the aforementioned object, the present invention discloses a modularized wireless earphone which comprises an inner module, a power supply unit, a loudspeaker and an outer casing. The inner module is provided at least with a circuit module and an insulated casing. The circuit module includes at least a detection juncture used for detecting, an ANT (Antenna) sensor, a receiving microphone and a control switch, with the detection juncture, the ANT sensor, the receiving microphone and the control switch being interconnected together electrically. The insulated casing is used to enclose the circuit module, and expose the detection juncture, the receiving microphone and the control switch outside an insulation body. The power supply unit is interconnected with the circuit module electrically to supply power. The loudspeaker is interconnected with the circuit module electrically; whereas, the outer casing is used to enclose the inner module, the power supply unit and the loudspeaker.

In an embodiment, the circuit module is further provided at least with a hard circuit board and a soft circuit board, wherein the detection juncture, the ANT sensor, the receiving microphone and the control switch are disposed on the hard circuit board, and the hard circuit board is enclosed in the insulated casing.

In an embodiment, the circuit module is further provided at least with a hard circuit board and a soft circuit board, wherein the detection juncture and the control switch are disposed on the hard circuit board, the ANT sensor and the receiving microphone are disposed on the soft circuit board, and the hard circuit board and the soft circuit board are enclosed in the insulated casing.

In an embodiment, the circuit module is further provided with a charging juncture, and the charging juncture is disposed on the soft circuit board.

In an embodiment, the circuit module is further provided with a light emitting unit which is disposed on the hard circuit board.

In an embodiment, the circuit module is further provided at least with a power supply juncture which is interconnected with the power supply unit electrically and is disposed on the hard circuit board.

In an embodiment, the circuit module is further provided at least with a charging juncture, a light emitting unit and a power supply juncture; whereas, the receiving microphone is further provided with a first receiving microphone and a second receiving microphone.

In an embodiment, the circuit module is further provided with a first hard circuit board, a second hard circuit board, a first soft circuit board which is connected between the first hard circuit board and the second hard circuit board, a second soft circuit board which is connected with the first hard circuit board, and a third soft circuit board which is connected with the second hard circuit board. The detection juncture, the control switch and the light emitting unit are disposed on the first hard circuit board, the power supply juncture is disposed on the second hard circuit board, the first receiving microphone is disposed on the first soft circuit board, the ANT sensor is disposed on the second soft circuit board, and the second receiving microphone and the power supply juncture are disposed on the third soft circuit board.

In an embodiment, the first hard circuit board and the second hard circuit board are not flexible and are enclosed in the insulated casing.

In an embodiment, the first soft circuit board, the second soft circuit board and the third soft circuit board are flexible and are enclosed in the insulated casing.

In comparison to the prior art, the modularized wireless earphone of the present invention, is provided with the advantage that as the inner module of the wireless earphone is designed modularly, the assembly procedure of the wireless earphone can be simplified, thereby reducing the manpower in assembling to decrease the assembly cost.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
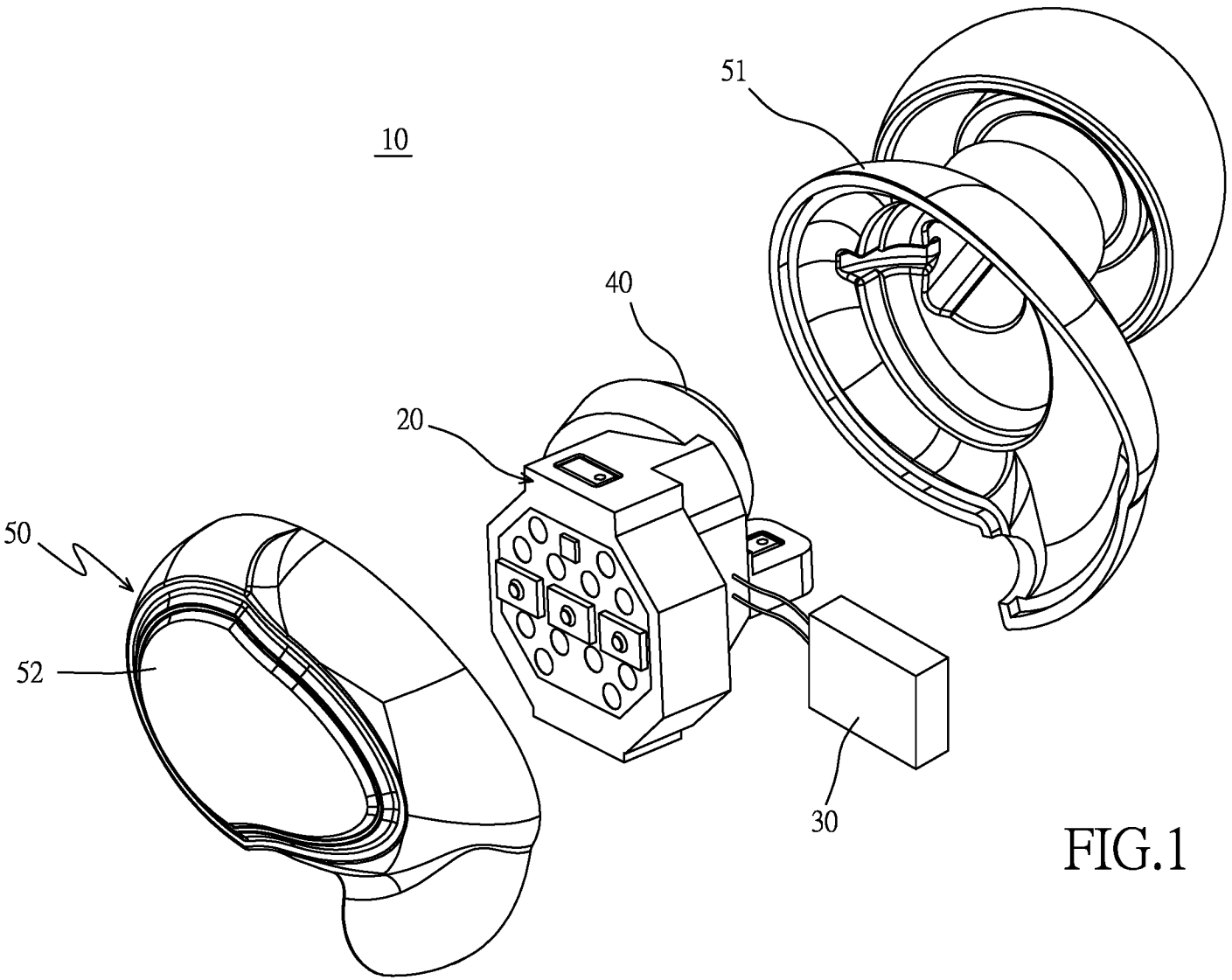
FIG. 1 shows an exploded view of the present invention.
Figure 2:
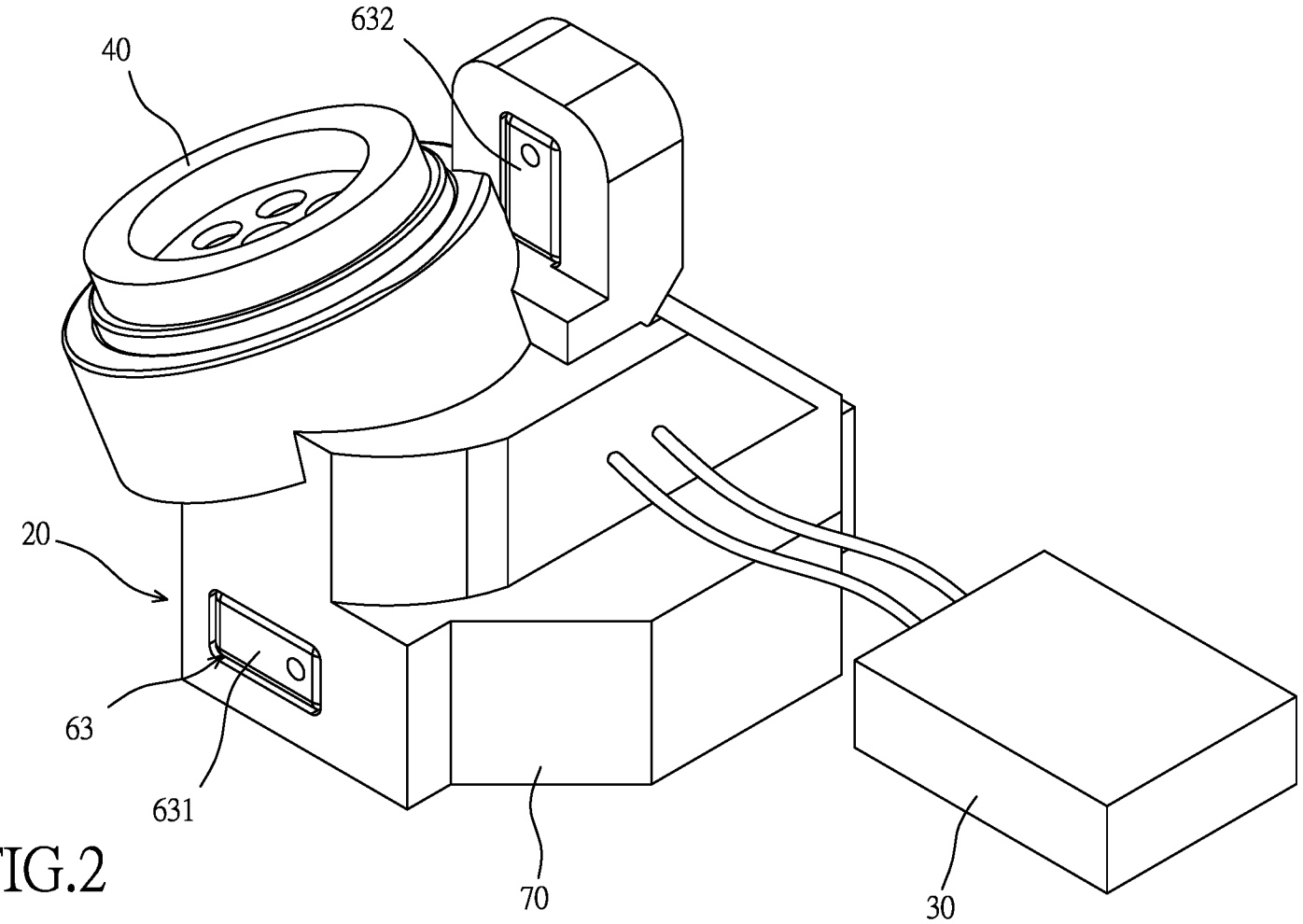
FIG. 2 shows a three-dimensional view of an inner module of the present invention at a first viewing angle.
Figure 3:
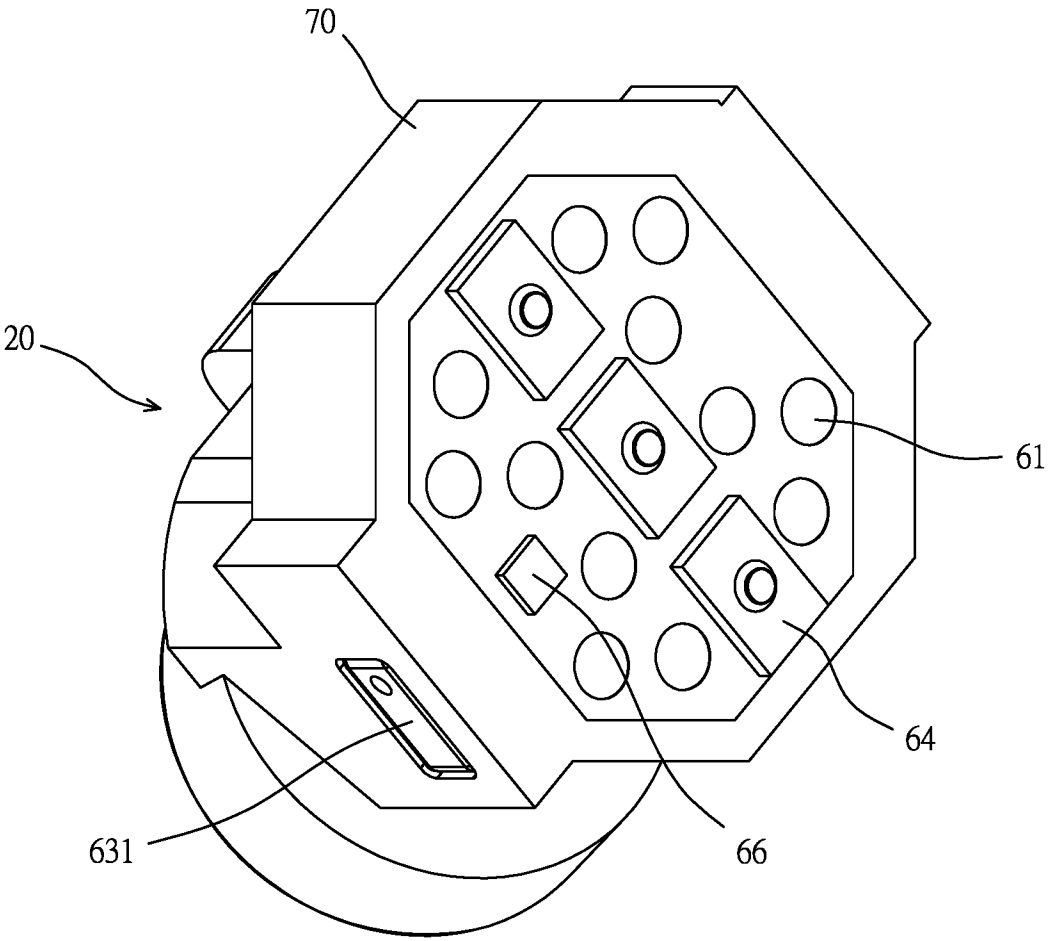
FIG. 3 shows a three-dimensional view of the inner module of the present invention at a second viewing angle.
Figure 4:
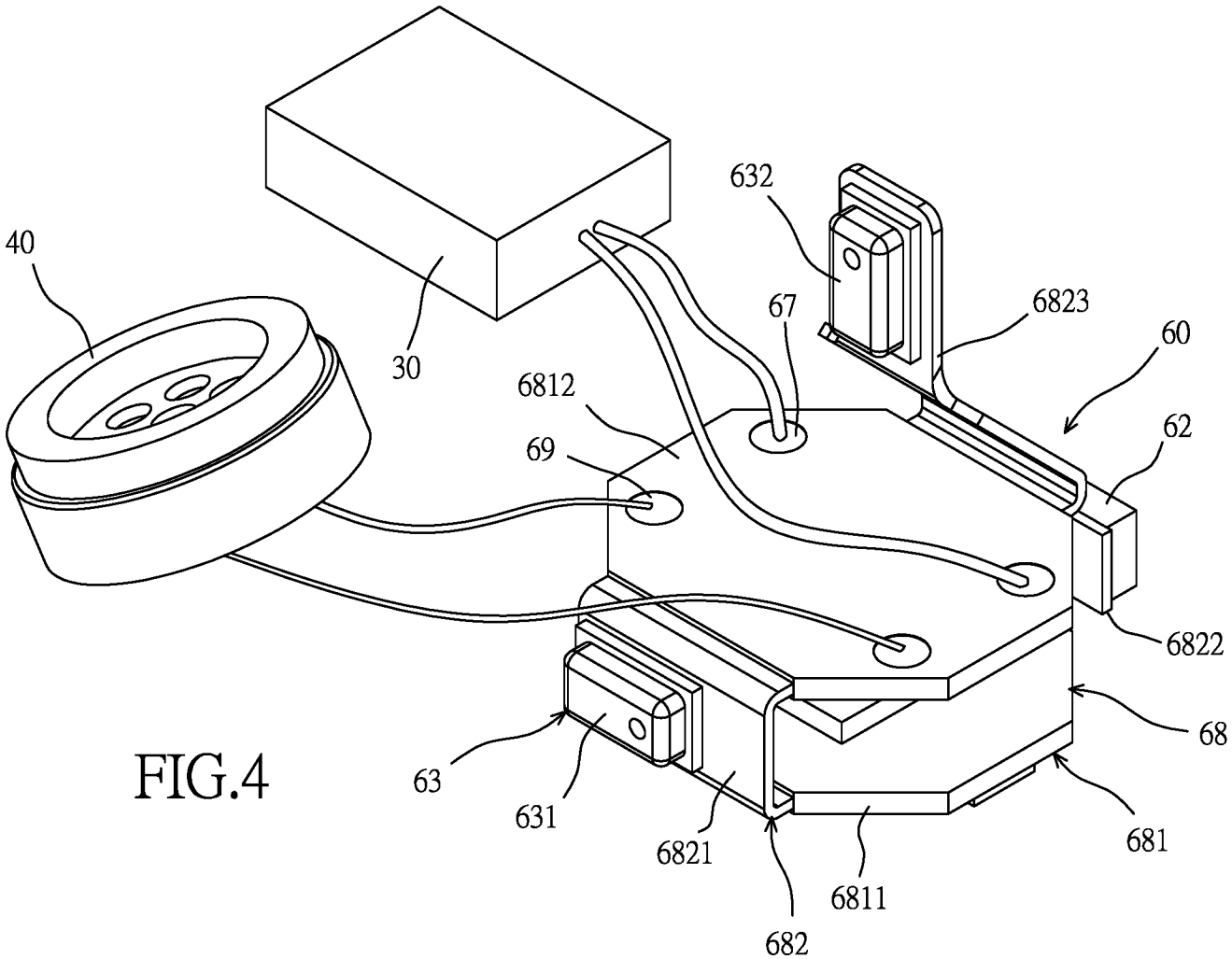
FIG. 4 shows a three-dimensional view of a circuit module of the present invention.
Figure 5:
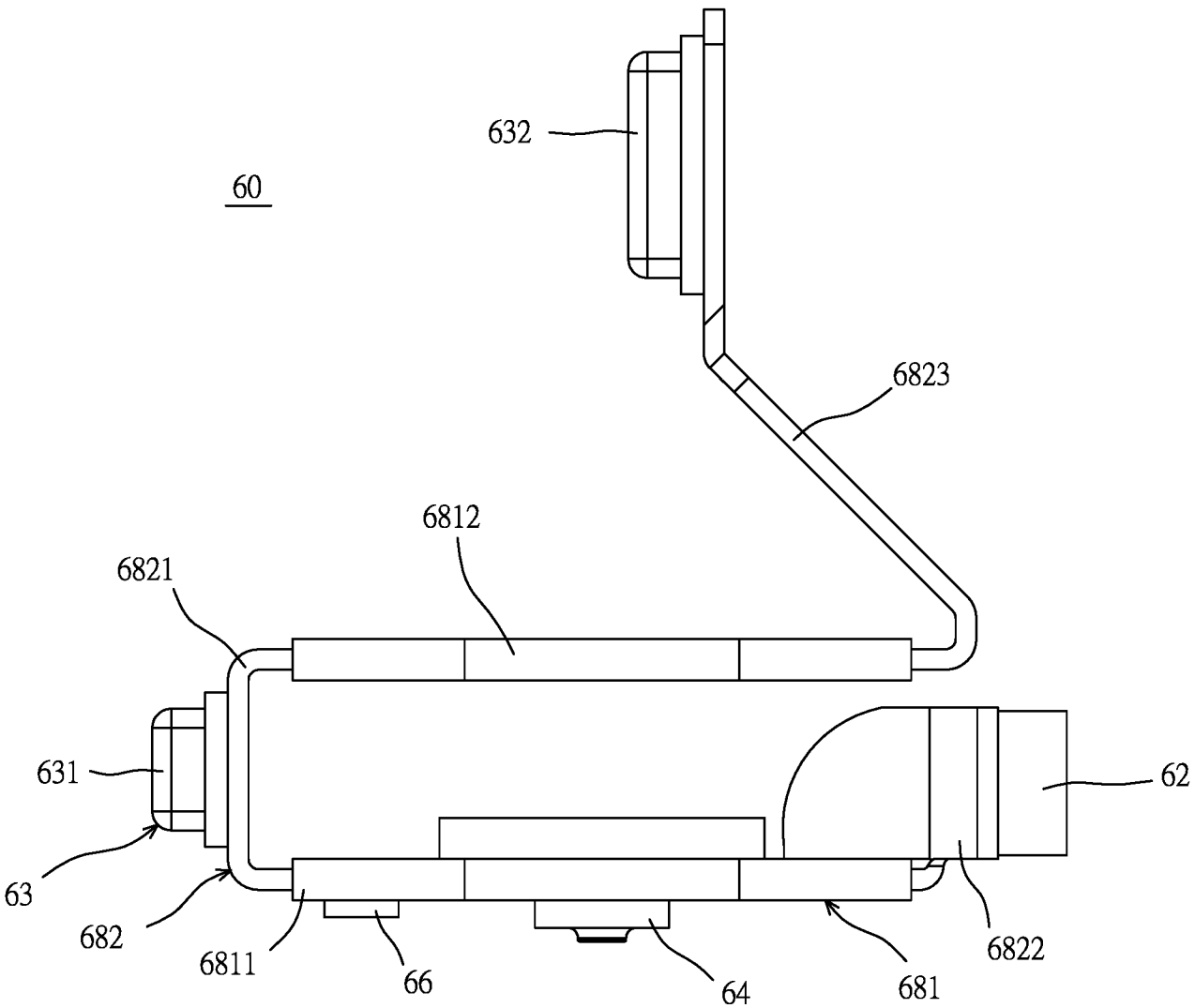
FIG. 5 shows a first planar view of the circuit module of the present invention.
Figure 6:
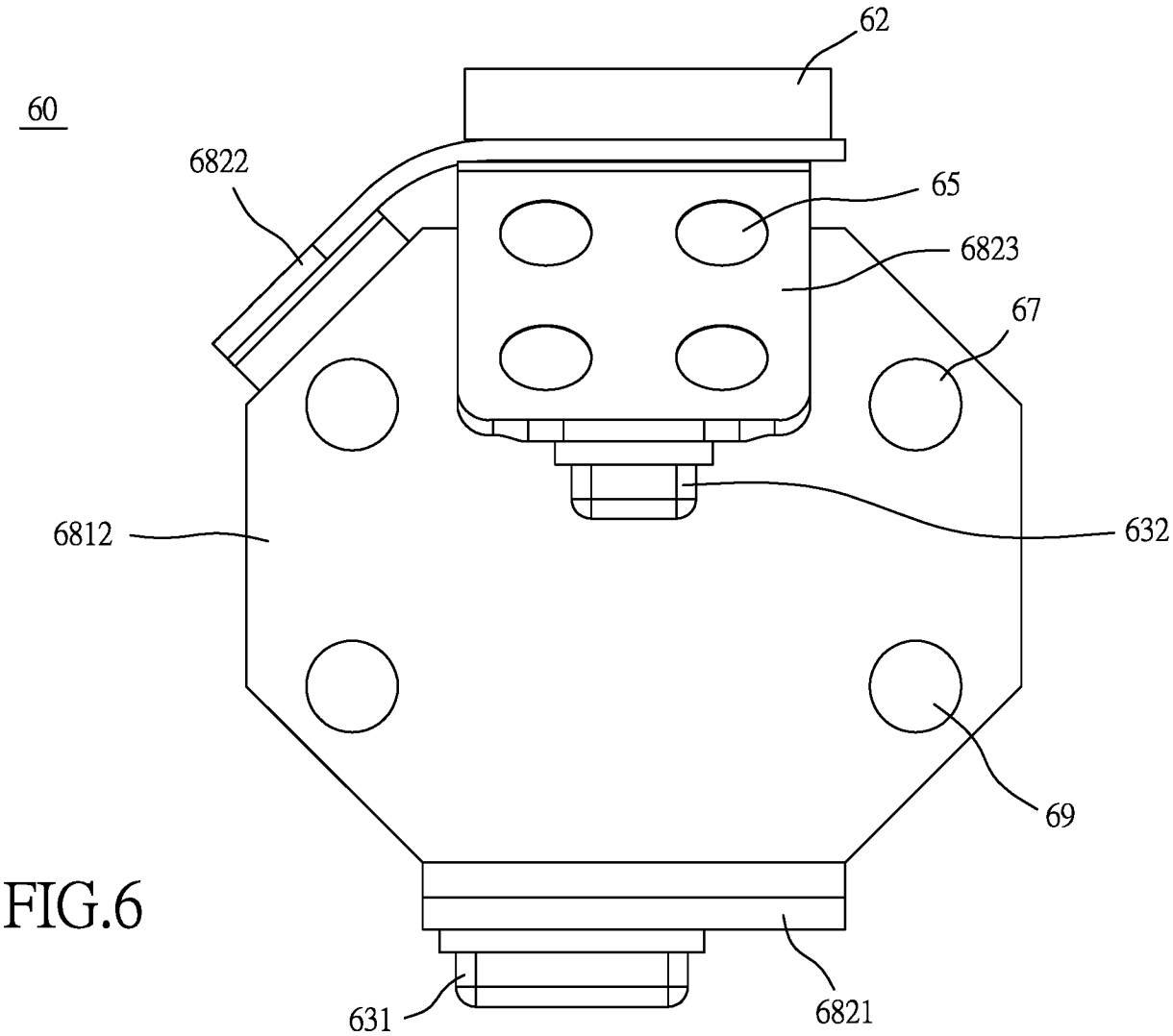
FIG. 6 shows a second planar view of the circuit module of the present invention.
Figure 7:
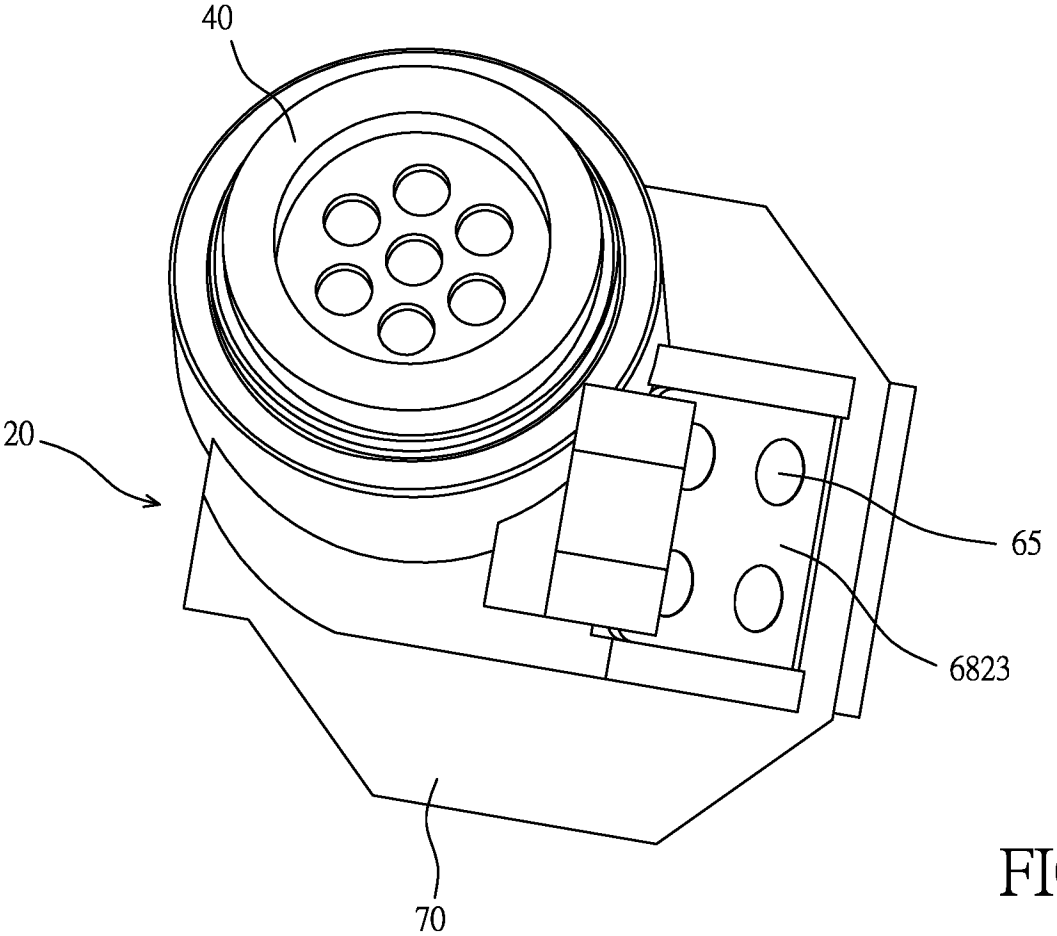
FIG. 7 shows a three-dimensional view of the inner module of the present invention at a third viewing angle.

Referring to FIGS. 1 to 4, the present invention discloses a modularized wireless earphone 10. In the present embodiment, the wireless earphone 10 comprises an inner module 20, a power supply unit 30, a loudspeaker 40 and an outer casing 50. The inner module 20 includes a circuit module 60 and an insulated casing 70. The circuit module 60 is provided with at least a detection juncture 61, an ANT sensor 62, a receiving microphone 63, a control switch 64, a charging juncture 65 (as shown in FIG. 6), a light emitting unit 66 and a power supply juncture 67, with the detection juncture 61, the ANT sensor 62, the receiving microphone 63, the control switch 64, the charging juncture 65, the light emitting unit 66 and the power supply juncture 67 being interconnected electrically. The circuit module 60 employs at least a circuit board 68 to enable the detection juncture 61, the ANT sensor 62, the receiving microphone 63, the control switch 64, the charging juncture 65, the light emitting unit 66 and the power supply juncture 67 to be interconnected electrically. The detection juncture 61 is used to detect whether the signal transmission of the circuit module 60 is normal. The ANT sensor 62 is used to transmit a wireless signal with a communication apparatus (not shown in the drawings, such as a cell phone or a tablet personal computer with the dialoging function). The receiving microphone 63 is used to receive the sound sent from a user and convert the sound into a digital signal by the circuit module 60. The control switch 64 is used to turn on and turn off the wireless earphone 10, and is able to control the volume when necessary. The charging juncture 65 is used to connect with an external power source (not shown in the drawings, such as a recharger) to recharge the power supply unit 30. The light emitting unit 66 is used to display the usage state of the wireless earphone 10. Finally, the power supply juncture 67 is used to connect with the power supply unit 30 electrically, providing electricity to the wireless earphone 10 for operation.

The circuit board 68 can be assembled from a single inflexible hard circuit board 681, can be assembled from at least an inflexible hard circuit board 681 and at least a flexible soft circuit board 682, or can be assembled from plural flexible soft circuit boards 682. In the present embodiment, the circuit module 60 includes a first hard circuit board 6811, a second hard circuit board 6812, a first soft circuit board 6821 which is connected between the first hard circuit board 6811 and the second hard circuit board 6812, a second soft circuit board 6822 which is connected with the first hard circuit board 6811, and a third soft circuit board 6823 which is connected with the second hard circuit board 6812. The detection juncture 61, the control switch 64 and the light emitting unit 66 are disposed on the first hard circuit board 6811, the power supply juncture 67 is disposed on the second hard circuit board 6812, and the ANT sensor 62 is disposed on the second soft circuit board 6822. Furthermore, in the present embodiment, the circuit module 60 is provided with two receiving microphones 63 as a primary configuration of implementation, including a first receiving microphone 631 and a second receiving microphone 632. The first receiving microphone 631 is disposed on the first soft circuit board 6821 to receive the sound outside the outer casing 50; whereas, the second receiving microphone 632 and the charging juncture 65 are disposed on the third soft circuit board 6823 (as shown in FIG. 6) to receive the sound inside the outer casing 50 to reduce the noises. In the present embodiment, the quantity and location of the circuit board 68, the detection juncture 61, the receiving microphone 63, the control switch 64, the charging juncture 65, the light emitting unit 66 and the power supply juncture 67 can be changed, increased or decreased, according to the functions of the wireless earphone 10.

On the other hand, the insulated casing 70 is used to enclose the circuit module 60, and expose the detection juncture 61, the receiving microphone 63, the control switch 64, the charging juncture 65 and the light emitting unit 66 outside the insulated casing 70. The insulated casing 70 can be formed by potting or injection molding. In other words, the first hard circuit board 6811, the second hard circuit board 6812, the first soft circuit board 6821, the second soft circuit board 6822 and the third soft circuit board 6823 are emplaced and positioned in a jig or mold (not shown in the drawings), and then the potting or injection molding is carried out, which enables the first hard circuit board 6811, the second hard circuit board 6812, the first soft circuit board 6821, the second soft circuit board 6822 and the third soft circuit board 6823 to be enclosed and fixed in the insulated casing 70. Thus, the inner module 20 can be formed with a modularized design, and the shape of the insulated casing 70 can be changed according to the profile of the wireless earphone 10 using the jig or mold.

The power supply unit 30 is interconnected with the power supply juncture 67 on the inner module 20 electrically, providing power required for the operation of the circuit module 60. Besides that, in the present embodiment, the power supply unit 30 can be connected with an external power source (not shown in the drawings, such as a recharger) through the charging juncture 65 on the inner module 20, so as to recharge the power supply unit 30. It is worth mentioning that the power supply unit 30 can also achieve the charging effect through the wireless charging technology.

The loudspeaker 40 is interconnected with the first hard circuit board 6811 on the inner module 20 electrically, and in order to allow the loudspeaker 40 to be connected with the first hard circuit board 6811 effectively, the first hard circuit board 6811 is further provided at least with a signal juncture 69, so that the first hard circuit board 6811 can be connected electrically with the loudspeaker 40 through the signal juncture 69. In the present embodiment, the loudspeaker 40 is embedded in the insulated casing 70 and is formed integrally with the insulated casing 70. When the loudspeaker 40 is embedded in the insulated casing 70, the loudspeaker 40 and the circuit module 60 are disposed primarily in the abovementioned jig or mold, followed by performing the potting or injection molding to embed the loudspeaker 40 in the insulated casing 70 and form the loudspeaker 40 with the insulated casing 70 integrally. Nevertheless, in practical application, the loudspeaker 40 can be also designed separately from the insulated casing 70.

The outer casing 50 is used to enclose the inner module 20, the power supply unit 30 and the loudspeaker 40, in order to constitute the wireless earphone 10. In the present embodiment, the outer casing 50 is assembled from a front casing 51 and a rear casing 52; whereas, the inner module 20, the power supply unit 30 and the loudspeaker 40 are disposed between the front casing 51 and the rear casing 52. However, in practical application, the outer casing 50 can be also formed integrally outside the inner module 20, the power supply unit 30 and the loudspeaker 40 through injection molding.

Accordingly, upon assembling the wireless earphone 10 of the present invention, as the inner module 20 has already been designed modularly, only the inner module 20, the power supply unit 30 and the loudspeaker 40 need to be assembled between the front casing 51 and the rear casing 52, followed by binding the front casing 51 with the rear casing 52. The binding method includes the high frequency welding technology, the ultrasonic welding technology or the application of adhesive glue. Therefore, the front casing 51 and the rear casing 52 can be adhered together effectively, so as to form the outer casing 50 of the wireless earphone 10. Accordingly, the assembly time can be reduced effectively and the assembly efficiency can be improved. In addition, the yield of assembly can be increased, as well. Besides that, through the modularized and integral design of the inner module 20, the labor of assembly can be decreased, which reduces the assembly cost significantly.

Furthermore, as shown in FIGS. 1 to 7, in the present embodiment, the circuit module 60 is formed by plural hard circuit boards 681 which are interconnected with plural soft circuit boards 682 electrically; whereas, the first hard circuit board 6811 and the second hard circuit board 6822 are parallel to each other. As the first soft circuit board 6821, the second soft circuit board 6822 and the third soft circuit board 6823 are flexible, when the first hard circuit board 6811, the second hard circuit board 6812, the first soft circuit board 6821, the second soft circuit board 6822 and the third soft circuit board 6823 are installed in the abovementioned jig or mold, the first hard circuit board 6811 and the second hard circuit board 6812 are disposed in the jig or mold parallel, and then the first soft circuit board 6821, the second soft circuit board 6822 and the third soft circuit board 6823 are pre-folded and fixed, followed by carrying out the potting or injection molding technology in the jig or mold, so as to achieve the modularized and integral design to the inner module 20 effectively.

On the other hand, in the present embodiment, prior to accomplishing the modularization to the inner module 20, the power supply unit 30 and the power supply juncture 67 are interconnected electrically, the loudspeaker 40 and the signal juncture 69 are interconnected electrically, and then the circuit module 60, the power supply unit 30 and the loudspeaker 40 are emplaced in the abovementioned jig or mold at a same time, followed finally by carrying out the potting or injection molding operation. Thus, the inner module 20, the power supply unit 30 and the loudspeaker 40 are formed into a modularized and integral design, and finally, the outer casing 50 is assembled to constitute the wireless earphone 10, which reduces the assembly procedure considerably and lowers the cost effectively. It is also without doubt that the power supply unit 30 and the loudspeaker 40 will not need to be integrally formed with the inner module 20, allowing the inner module 20, the power supply unit 30 and the loudspeaker 40 to be adapted at the proper locations according to the shape of the outer casing 50 to increase the versatility of the wireless earphone 10.

In accordance with the abovementioned descriptions, the present invention discloses a modularized wireless earphone, wherein the power supply unit 30 provides the power required for the operation of the wireless earphone 10, the ANT sensor 62 conducts the wireless signal transmission with the abovementioned communication apparatus to receive the sound from a user through the first receiving microphone 631 and reduces the noises using the second receiving microphone 632, and then transmits the sound signal to the abovementioned communication apparatus which in turn transmits the sound signal to a receiver. On the other hand, after the communication apparatus receives a signal which is responded by the receiver, the communication apparatus will then transmit the signal to the wireless earphone 10 through the ANT sensor 62, and convert the signal into a sound signal which will be finally played on the loudspeaker 40, enabling the user to receive the sound from the receiver. On the other hand, the volume of the wireless earphone 10 can be adjusted or the wireless earphone 10 can be turned on or off through the control switch 64; whereas, the usage state of the wireless earphone 10 can be observed through the light emitting unit 66.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A modularized wireless earphone comprising:

an inner module which is provided with a circuit module and an insulated casing, with that the circuit module includes an ANT (Antenna) sensor, a receiving microphone, and a control switch used for turning on and off the wireless earphone, the ANT sensor, the receiving microphone and the control switch are interconnected electrically, and the insulated casing is used to enclose a portion of the circuit module, the receiving microphone and the control switch, which are not enclosed by the insulated casing, outside the insulated casing;

a power supply unit which is interconnected with the circuit module electrically to provide electricity;

a loudspeaker which is interconnected with the circuit module electrically; and an outer casing which is used to enclose the inner module, the power supply unit and the loudspeaker.

2. The modularized wireless earphone according to claim 1, wherein the circuit module is further provided with a hard circuit board, the ANT sensor, the receiving microphone and the control switch are disposed on the hard circuit board, and the hard circuit board is enclosed in the insulated casing.

3. The modularized wireless earphone according to claim 2, wherein the circuit module is further provided with a light emitting unit which is disposed on the hard circuit board.

4. The modularized wireless earphone according to claim 2, wherein the circuit module is further provided with a power supply juncture which is interconnected with the power supply unit electrically, and the power supply juncture is disposed on the hard circuit board.

5. The modularized wireless earphone according to claim 1, wherein the circuit module is further provided with a hard circuit board and a soft circuit board, the control switch is disposed on the hard circuit board, the ANT sensor and the receiving microphone are disposed on the soft circuit board, and the hard circuit board and the soft circuit board are enclosed in the insulated casing.

6. The modularized wireless earphone according to claim 5, wherein the circuit module is further provided with a charging juncture which is disposed on the soft circuit board.

7. The modularized wireless earphone according to claim 5, wherein the circuit module is provided with a light emitting unit which is disposed on the hard circuit board.

8. The modularized wireless earphone according to claim 5, wherein the circuit module is further provided with a power supply juncture which is interconnected with the power supply unit electrically, and the power supply juncture is disposed on the hard circuit board.

9. The modularized wireless earphone according to claim 1, wherein the circuit module is further provided with a charging juncture, a light emitting unit and a power supply juncture, whereas the receiving microphone is further provided with a first receiving microphone and a second receiving microphone.

10. The modularized wireless earphone according to claim 9, wherein the circuit module is further provided with a first hard circuit board, a second hard circuit board, a first soft circuit board which is connected between the first hard circuit board and the second hard circuit board, a second soft circuit board which is connected with the first hard circuit board, and a third soft circuit board which is connected with the second hard circuit board, the control switch and the light emitting unit being disposed on the first hard circuit board, the power supply juncture being disposed on the second hard circuit board, the first receiving microphone being disposed on the first soft circuit board, the ANT sensor being disposed on the second soft circuit board, and the second receiving microphone and the power supply juncture being disposed on the third soft circuit board.

11. The modularized wireless earphone according to claim 10, wherein the first hard circuit board and the second hard circuit board are not flexible and are enclosed in the insulated casing.

12. The modularized wireless earphone according to claim 10, wherein the first soft circuit board, the second soft circuit board and the third soft circuit board are flexible and are enclosed in the insulated casing.

* * * * *